US007318267B2

(12) United States Patent
Honjou

(10) Patent No.: US 7,318,267 B2
(45) Date of Patent: Jan. 15, 2008

(54) STRIP PRODUCTION EQUIPMENT

(75) Inventor: Hisashi Honjou, Kanagawa (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 371 days.

(21) Appl. No.: 10/514,725

(22) PCT Filed: Jul. 11, 2003

(86) PCT No.: PCT/JP03/08815

§ 371 (c)(1),
(2), (4) Date: Nov. 24, 2004

(87) PCT Pub. No.: WO2004/009272

PCT Pub. Date: Jan. 29, 2004

(65) Prior Publication Data

US 2006/0059679 A1 Mar. 23, 2006

(30) Foreign Application Priority Data

Jul. 18, 2002 (JP) ..... 2002-210117

(51) Int. Cl.
*B21B 13/22* (2006.01)
*B21B 1/16* (2006.01)
*B22D 46/00* (2006.01)
*B22D 11/12* (2006.01)

(52) U.S. Cl. ..... 29/527.6; 29/33 C; 72/203; 164/460; 164/461; 164/476; 222/591; 228/173.7

(58) Field of Classification Search ..... 148/541; 222/591, 592, 593; 228/13, 18, 19, 20.1, 228/22, 173.7, 235.1, 235.2, 235.3; 29/527.5, 29/527.7, 564, 564.1, 564.6, 564.7, 564.8, 29/33 R, 33 C; 72/6.2, 13.1, 13.2, 199, 200, 72/203, 234; 164/4.1, 413, 417, 418, 443, 164/442, 459, 460, 461, 476, 477, 479, 485, 164/488

See application file for complete search history.

(56) References Cited

U.S. PATENT DOCUMENTS

| | | | | |
|---|---|---|---|---|
| 4,113,166 | A * | 9/1978 | Olsson | 228/170 |
| 4,477,011 | A * | 10/1984 | Austin | 228/173.2 |
| 4,691,758 | A * | 9/1987 | Palmer | 164/461 |
| 4,804,037 | A * | 2/1989 | Nomura et al. | 164/450.4 |
| 4,830,087 | A * | 5/1989 | Kothe et al. | 164/460 |
| 4,846,254 | A * | 7/1989 | Kimura | 164/476 |
| 4,955,216 | A * | 9/1990 | Barker et al. | 72/13.4 |
| 4,958,677 | A * | 9/1990 | Kimura | 164/452 |
| 5,285,670 | A * | 2/1994 | Thomas | 72/146 |
| 5,503,217 | A * | 4/1996 | Perry et al. | 164/477 |
| 6,585,799 | B1 * | 7/2003 | Zeze et al. | 75/568 |
| 6,789,602 | B2 * | 9/2004 | Li et al. | 164/4.1 |
| 6,918,969 | B2 * | 7/2005 | Zeze et al. | 148/404 |

FOREIGN PATENT DOCUMENTS

DE 100 60 948 A1 6/2002

(Continued)

*Primary Examiner*—Dana Ross
(74) *Attorney, Agent, or Firm*—Oblon, Spivak, McClelland, Maier & Neustadt, P.C.

(57) ABSTRACT

Arranged are a twin- or single-roll continuous casting machine supplied with molten metal from a tundish arranged above so as to continuously cast a strip with a predetermined width, a trimmer arranged downstream of the continuous casting machine to trim widthwise edges of the strip and a rolling mill arranged downstream of the trimmer.

1 Claim, 10 Drawing Sheets

FOREIGN PATENT DOCUMENTS

| | | |
|---|---|---|
| JP | 63-317240 | 12/1988 |
| JP | 64-083352 | 3/1989 |
| JP | 6-134554 | 5/1994 |
| JP | 6-335819 | 12/1994 |
| JP | 8-224639 | 9/1996 |
| JP | 2001-314947 | 11/2001 |

* cited by examiner

STRIP PRODUCTION EQUIPMENT

TECHNICAL FIELD

The present invention relates to a strip product production installation which prevents any troubles in rolling of a strip or any flatness defectiveness of the strip after rolling even if the strip produced by a continuous casting machine may have thickness defects on widthwise edges thereof due to flaws and/or edge-up or drops.

BACKGROUND ART

In order to produce cast strip products in the form of sheet, conventionally continuous casting installations are used. A typical continuous casting installation is shown in FIGS. 1 and 2 in which reference numerals 1*a* and 1*b* denote a pair of or front and back casting rolls arranged horizontally and side by side and rotatable downward and toward to each other, the casting rolls 1*a* and 1*b* being adapted to be internally cooled through communication of cooling fluid in the rolls. Thus, casting rolls 1*a* and 1*b* provides a continuous casting machine 1. In conventional continuous casting, a typical cast strip thickness is 30 mm or more; however, in recent roll casting, a cast strip thickness may be thinner and may be 15 mm or less.

Reference numeral 2 denotes a molten metal nozzle arranged above a molten metal pool between the casting rolls 1*a* and 1*b*; 3, a tundish arranged above the nozzle 2 to feed molten metal 4 to the nozzle 2; 5, side weirs arranged laterally and oppositely of the casting roll 1*a* and 1*b* to abut on ends of the casting rolls 1*a* and 1*b* so as to prevent the molten metal 4 from leaking from the molten metal pool; 6, a cast piece or strip in the form of thin sheet and formed by cooling of the casting rolls 1*a* and 1*b*; 7, pinch rolls arranged downward of the casting rolls 1*a* and 1*b* to draw out the strip 6; and 2*a*, side flow channels formed on opposite sides of the molten metal nozzle 2.

In the above-mentioned continuous casting machine 1, molten metal 4 is fed from the molten metal nozzle 2 to between the casting rolls 1*a* and 1*b* to form the molten metal pool, the molten metal 4 being cooled by the casting rolls 1*a* and 1*b* and being delivered as the strip 6 from between the rolls through rotation of the latter.

However, when a continuous casting operation is effected by the above-mentioned continuous casting machine 1, in triple point 8 provided by the rotated casting rolls 1*a* and 1*b*, side weirs 5 and molten metal 4 as shown in FIG. 3, a solidified shell 9 integrally develops on peripheries of the casting rolls 1*a* and 1*b* and on inner surfaces of the side weirs 5. Rotation of the casting rolls 1*a* and 1*b* may cause such solidified shell 9 to be plucked away to produce triple point problems such as formation of infinitely-lacking shape defects on widthwise edges of the strip 6, flow out of the unsolidified inner molten metal 4 and fractures of the strip 6.

To overcome this, recently, formation of the solidified shell 9 on the side weirs 5 has been prevented such that part of the molten metal 4 fed from the nozzle 2 to the molten metal pool is made to flow via side flow channels 2*a* positively to the triple point 8 regions to thereby prevent formation of the solidified shell 9 on the side weirs 5. In this respect, the fed amount of the molten metal 4 is controlled depending upon thickness and production speed of the strip 6 to be cast so as to retain a pool surface height H constant.

However, in the above-mentioned conventional system, too much flow rate of the molten metal 4 fed to the triple point 8 regions may cause the solidified shell 9 on the casting rolls 1*a* and 1*b* to be also melted, resulting in shape defects 11 such as droplet-like leaks and bulges on the widthwise edges of the strip 6; too little flow amount to the triple point 8 may cause the above-mentioned triple point problems.

Any try to control the flow rate of the molten metal 4 fed to the triple point 8 would vary the pool surface height H, resulting in deviation in supply position of the molten metal 4 directed to the triple point 8 for prevention of the triple point problems to thereby produce the above-mentioned shape defects 10 and 11.

Therefore, conventionally, control is made to retain the pool surface height H constant; the fed amount of the molten metal 4 to the triple point 8 is not controlled at all. As a result, any change of the above-mentioned casting conditions may produce shape defects 10 and 11 on the widthwise edges of the strip 6, leading to deterioration of product quality, difficulties in succeeding operations such as rolling and resultant increase in cost. Especially, upon startup of a casting operation, the molten metal 4 may be solidified in a flow channel in the molten metal nozzle 2 to narrow the section of the flow channel and reduce the flow rate so that the triple point problems occur significantly, resulting in problems such as reduction of yield of the strip 6.

Continuous casting machines for solving such problems have been proposed as shown in JP-63-317240A. In such continuous casting machine, as shown in FIG. 4, a continuous casting machine 1 comprising two casting rolls 1*a* and 1*b* defines together with opposite side weirs 5 a molten metal pool; and a tundish 3 arranged above the pool is formed with a main flow channel 3*a* and side flow channels 3*b* which feed the molten metal 4 to the opposite triple point regions of the molten metal pool, the flow rates of the molten metal 4 flowing through the respective flow channels 3*a* and 3*b* being individually controlled by control members 14 and 15 vertically movable through actuators 12 and 13, respectively.

In the case of shape defects 10 being generated on the widthwise edges of the strip 6 in the continuous casting machine 1 of FIG. 4, opening degrees of the side flow channels 3*b* are controlled by the control members 15 to control the fed amount of molten metal to the triple point regions so as to eliminate the shape defects 10 on the widthwise edges of the strip 6. Any variation of the pool surface height H due to variation in the fed amount of the molten metal to the triple point 8 is absorbed by controlling the opening degree of the main flow channel 3*a* through the control member 14 to control the amount of the molten metal flowing through the mail flow channel 3*a*, thereby maintaining the pool surface height H constant.

The side flow channels 3*b* of the tundish 3 shown in FIG. 4 are generally narrow and unstable and may be clogged when the molten metal 4 flow through them; as a result, they have insufficient effect on compensation of the shape defects (flaws) 10 on the widthwise edges of the strip 6. Therefore, in the case of the strip 6 being rolled by a downstream rolling mill, this may cause frequent meanderings and/or fractures of a strip product produced by rolling of the strip 6. Such shape defect problems are especially critical in the case of the cast strip thickness of 15 mm or less since meanderings further tend to occur upon rolling due to the thin cast strip thickness, resulting in increase in number of troubles.

When the casting rolls 1*a* and 1*b* are deformed into convex as shown in FIG. 5 under the influence of for example heat, the cast strip 6 may have sectional shape as shown in FIG. 6 with convex portions 6*a* at widthwise edges due to edge-up; when the casting rolls 1*a* and 1*b* become concave as shown in FIG. 7 due to grinding, the strip 6 may have sectional shape as shown in FIG. 8 with concave portions 6*b* at widthwise edges due to edge-down.

As a result, in the case of the strip 6 being rolled by the downstream rolling mill, elongation ratio of the strip may be nonuniform widthwise, resulting in generation of shape defects. Such edge-up or -drop may be generated frequently dissymmetry widthwise. Furthermore, structurally with respect to plastic mass flow of the strip product rolled, elongation longitudinally of the strip may increase in comparison with that widthwise of the strip, resulting in increased flatness defectiveness of the strip longitudinally of the strip.

In view of the above, the invention has its object to prevent any troubles in rolling of a strip or prevent any flatness defectiveness of the strip after rolling even if the strip produced by a continuous casting machine may have thickness defects on widthwise edges thereof due to flaws and/or edge-up or -drops.

SUMMARY OF THE INVENTION

The invention resides in trimmers for trimming widthwise edges of a strip, said trimmers being arranged upstream of a rolling mill arranged downstream of a twin- or single-roll continuous casting machine supplied with molten metal from a tundish arranged above for continuously casting a strip with a predetermined width.

The invention further resides in trimmers for trimming widthwise edges of a strip, said trimmers being arranged upstream of a rolling mill arranged downstream of a continuous casting line comprising a twin- or single-roll continuous casting machine supplied with molten metal from a tundish arranged above for continuously casting a strip with a predetermined width and a coiler for coiling the strip cast. This is meritorious in operation especially in the case of a cast strip thickness of less than 15 mm where generally the operation becomes efficient through processing by coiling means.

The invention further resides in flaw and thickness detectors arranged upstream of the trimmers for sensing flaws on the widthwise edges of the strip and for sensing thickness widthwise of the strip, respectively, and means for adjusting positions of trimmer blades widthwise of the strip on the basis of an output from said flaw detector and/or an output from said thickness detector.

Thus, according to the invention, in the case where a strip produced by a continuous casting machine has widthwise edges with shape defects such as flaws and/or thickness defects, rolling can be carried out after such portions are trimmed away, advantageously resulting in prevention of any troubles in rolling due to for example meanderings and fractures of the strip and prevention of shape defects on the strip product after rolling due to longitudinal plastic mass flow.

BEST MODE FOR CARRYING OUT THE INVENTION

Embodiments of the invention will be described in conjunction with the drawings.

Figure 1:
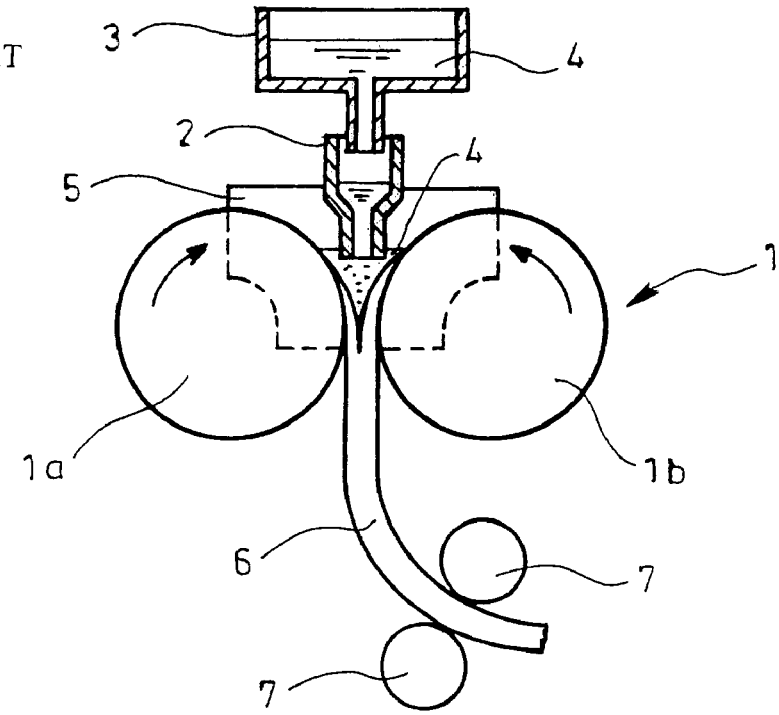
FIG. 1 PRIOR ART
FIG. 1 is a side view schematically showing a typical continuous casting machine used for a strip product production installation.
Figure 2:
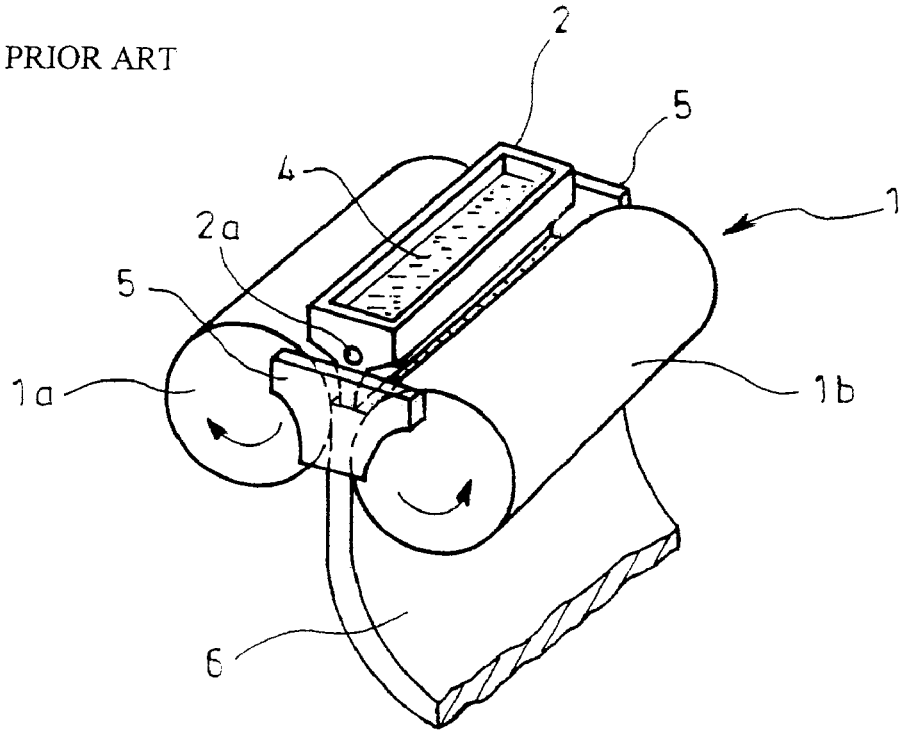
FIG. 2 PRIOR ART
FIG. 2 is a perspective view of the continuous casting machine when viewed from the right in FIG. 1.
Figure 3:
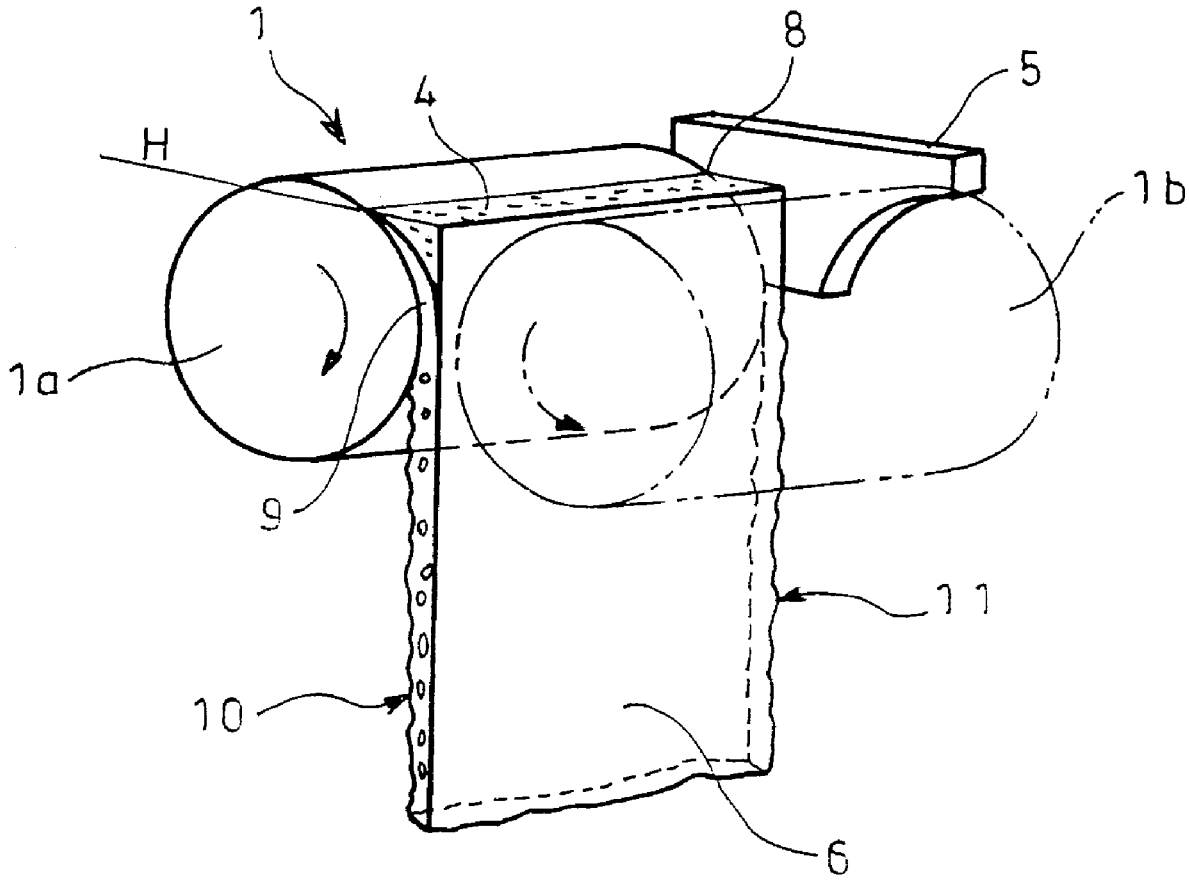
FIG. 3 PRIOR ART
FIG. 3 is a perspective view for explanation of shape defects generated upon production of the strip by the continuous casting machine of FIGS. 1 and 2.
Figure 4:
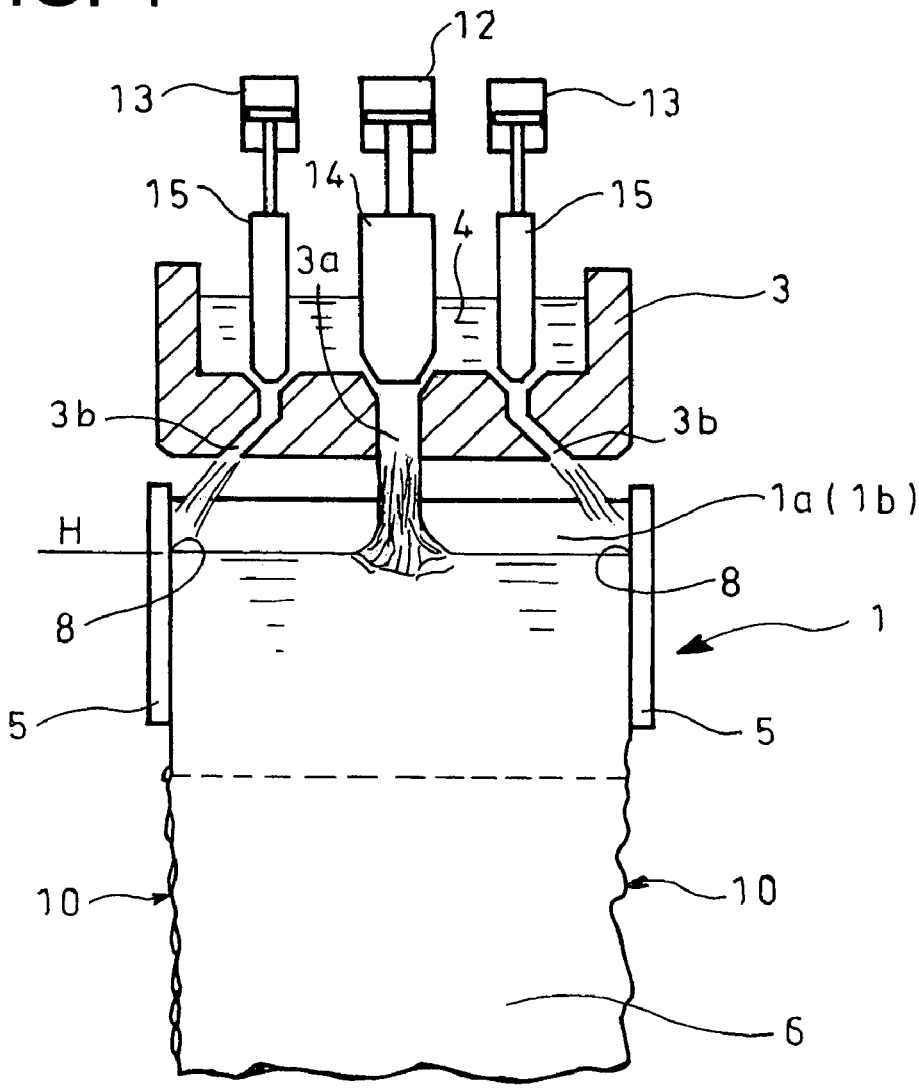
FIG. 4 is a front view partly in section of a continuous casting machine adapted not to produce the shape defects shown in FIG. 3.
Figure 5:
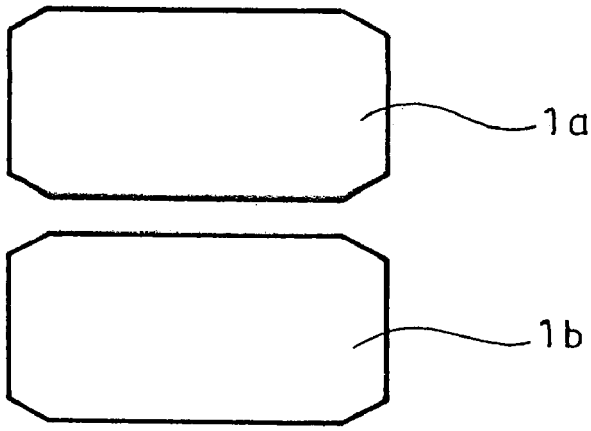
FIG. 5 is a plan view showing an example of the casting roll contour used in the continuous casting machine.
Figure 6:
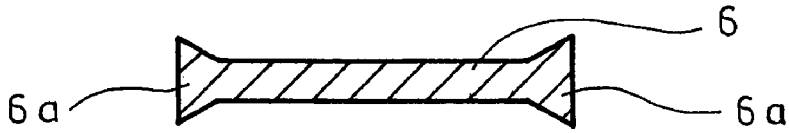
FIG. 6 is a sectional view showing the strip cast by the casting rolls in FIG. 5.
Figure 7:
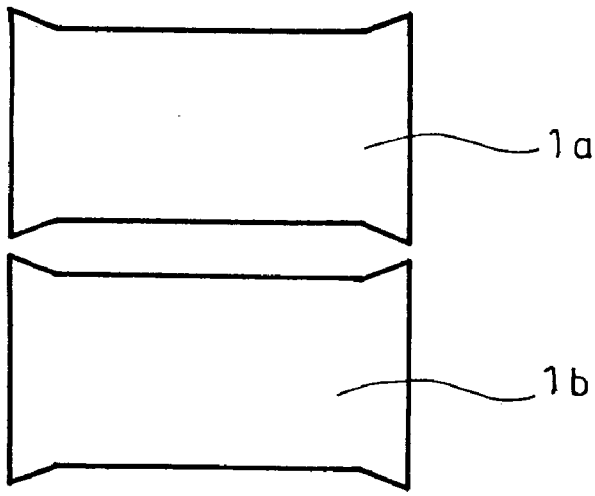
FIG. 7 is a plan view showing a further example of the casting roll contour.
Figure 8:
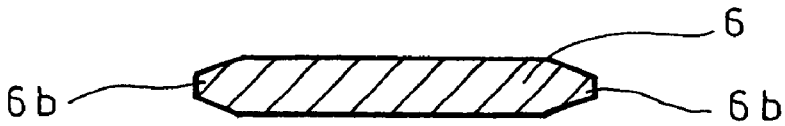
FIG. 8 is a sectional view showing the strip cast by the casting rolls in FIG. 7.
Figure 9:
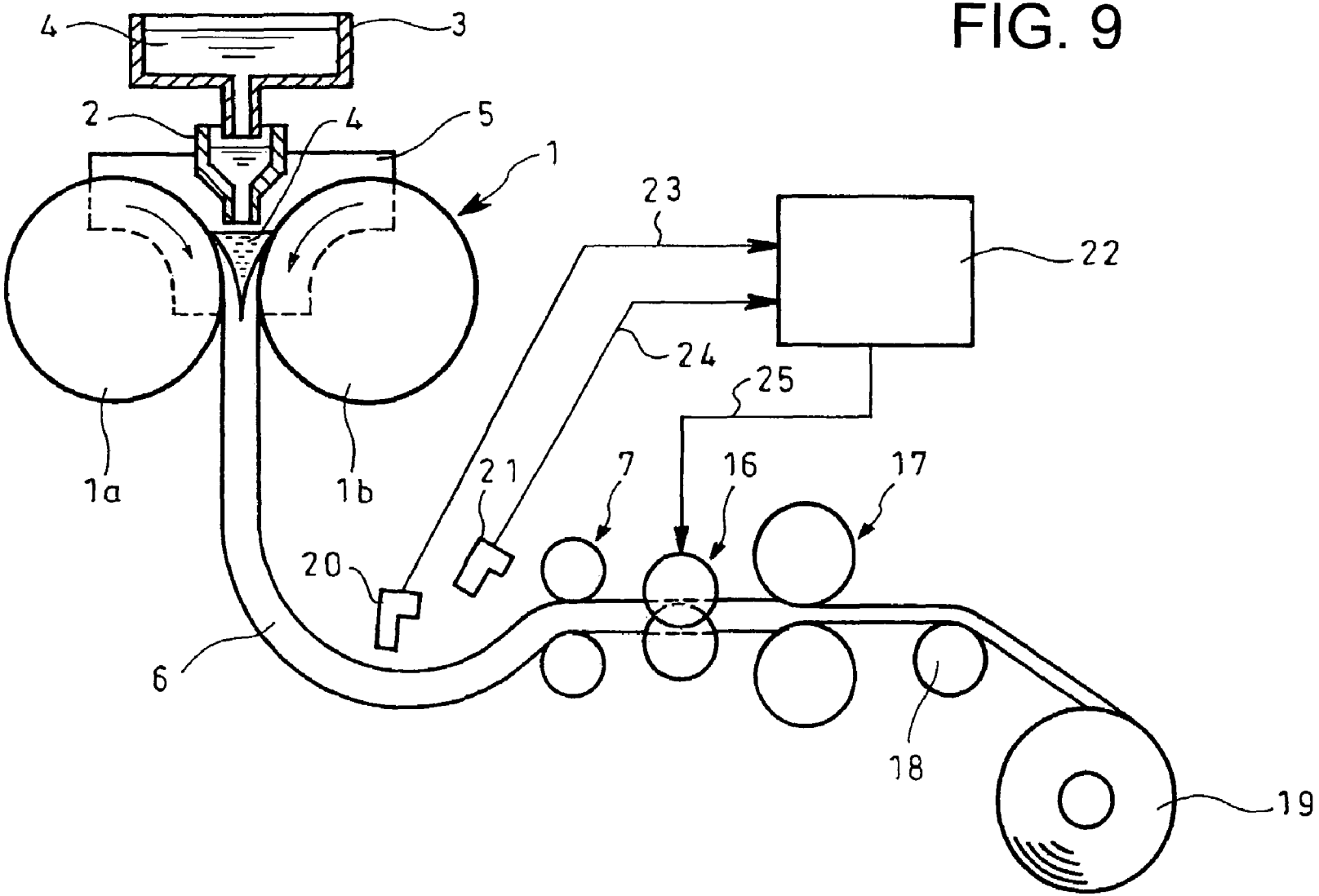
FIG. 9 is a schematic side view showing an embodiment of a strip product production installation according to the invention.

FIGS. 9-12 show an embodiment of the invention. A continuous casting machine of a strip product production installation shown in FIG. 9 has a structure same as that of the continuous casting machine shown in FIGS. 1 and 2. In FIG. 9, parts similar to those shown in FIGS. 1 and 2 are represented by the same reference numerals. Reference numeral 16 denotes trimmers arranged downstream of pinch rolls 7; 17, a rolling mill arranged downstream of the trimmers 16; 18, a deflector roll arranged downstream of the rolling mill 17; and 19, a coiler arranged downstream of the deflector roll 18.

Reference numeral 20 denotes a flaw detector arranged between the continuous casting machine 1 and the pinch rolls 7 to sense flaws as shape defects on widthwise edges of the strip 6; 21, a thickness detector arranged close to the flaw detector 20 to sense widthwise thickness of the strip 6; and 22, a trimming-amount arithmetic and control unit which processes flaw and thickness signals 23 and 24 from the flaw and thickness detectors 20 and 21, respectively, to transmit commands 25 to the trimmers 16 when the widthwise edges of the strip 6 have flaws or thickness defects such as edge-up or -drop.

Figure 10:
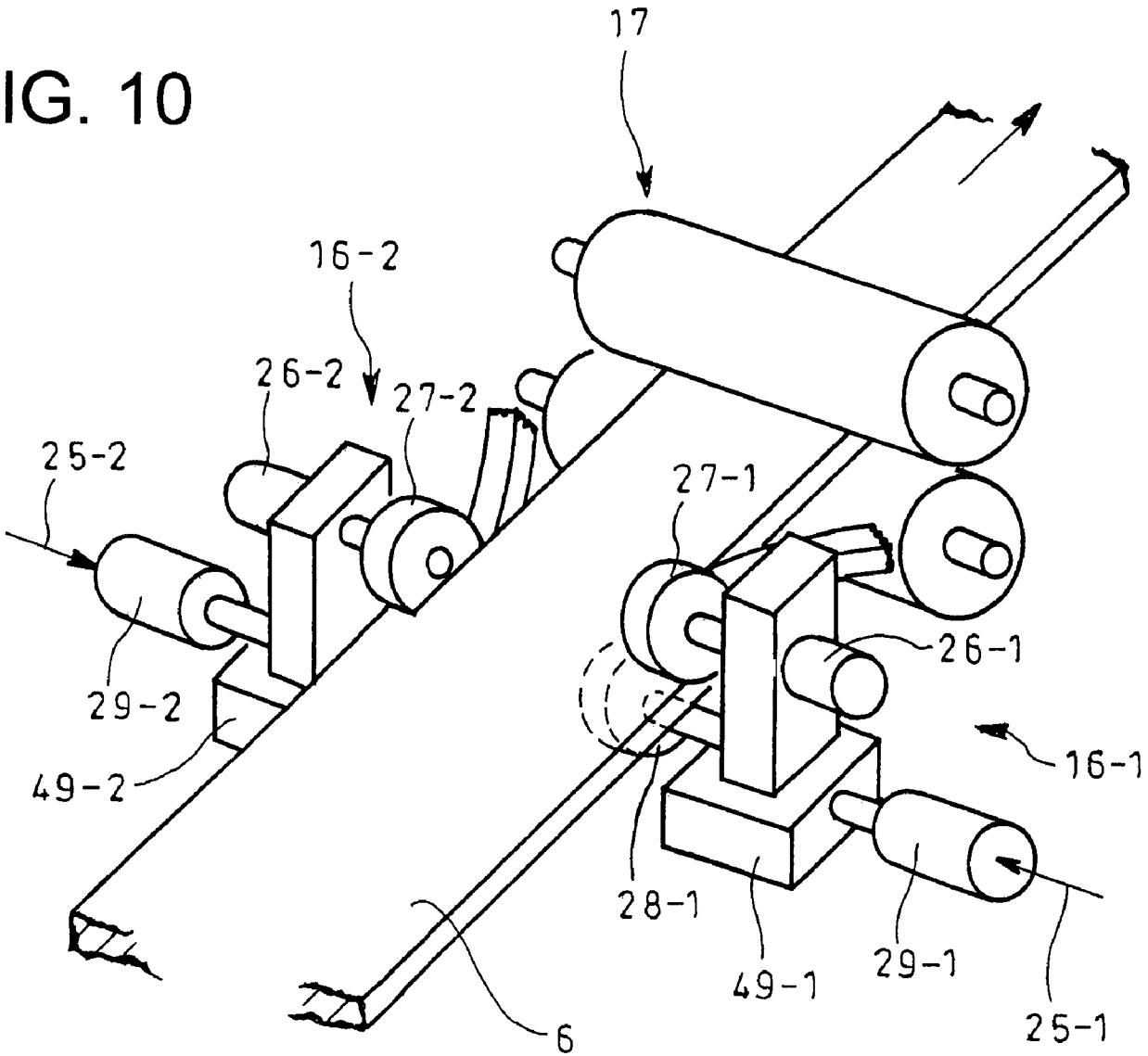
FIG. 10 is a perspective view showing a trimmer and a rolling mill used in the strip product production installation according to the invention.
Figure 11:
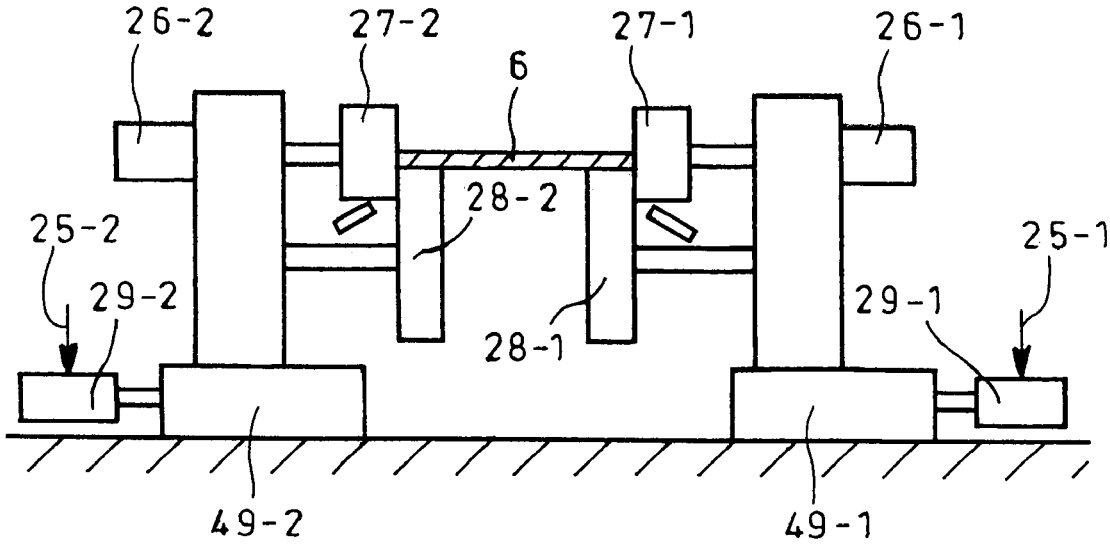
FIG. 11 is a schematic front view showing the trimmer used in the strip product production installation according to the invention.

The trimmers 16 have, as shown in FIGS. 10 and 11, laterally arranged upper and lower blades 27 and 28 which may be driven by drives 26, and positions of the blades 27 and 28 widthwise of the strip 6 may be adjusted by widthwise-position adjusters 29. Widthwise-position adjustment of the blades 27 and 28 may be carried out by the commands 25 from the trimming-amount arithmetic and control unit 22.

The upper blade 27 and the lower blade are supported by blade supports 49. The blade supports 49 may be individually and independently adjusted by widthwise-position adjusters 29. Depending upon the signals of the commands 25, both of the blade supports 49 may be moved by the same degree. The blade supports 49 are guided by guideways (not shown) such that they may be moved widthwise. All of the trimmers 16, the commands 25, the drives 26, the upper and lower blades 27 and 28, the widthwise-position adjusters 29 and the blade supports 49 are arranged laterally oppositely so that, in FIGS. 11 and 12, the laterally opposite parts are dividedly represented with suffixes −1 and −2.

Next, the operation of the above-mentioned embodiment will be described.

The molten metal 4 fed from the tundish 3 via the molten metal nozzle 2 to the molten metal pool is cooled by the casting rolls 1*a* and 1*b* rotated in the directions of arrows to solidify into a solidified shell which develops into the strip 6. Then, the strip 6 is drawn out between the casting rolls 1*a* and 1*b* by the pinch rolls 7 to be fed downstream. When the flaw detector 20 senses a flaw on the widthwise edge of the strip 6, it transmits a flaw signal 23 to the trimming-amount arithmetic and control unit 22; the thickness signal 24 on the thickness of the strip 6 sensed by the thickness detector 21 is transmitted to the trimming-amount arithmetic and control unit 22.

Figure 12:
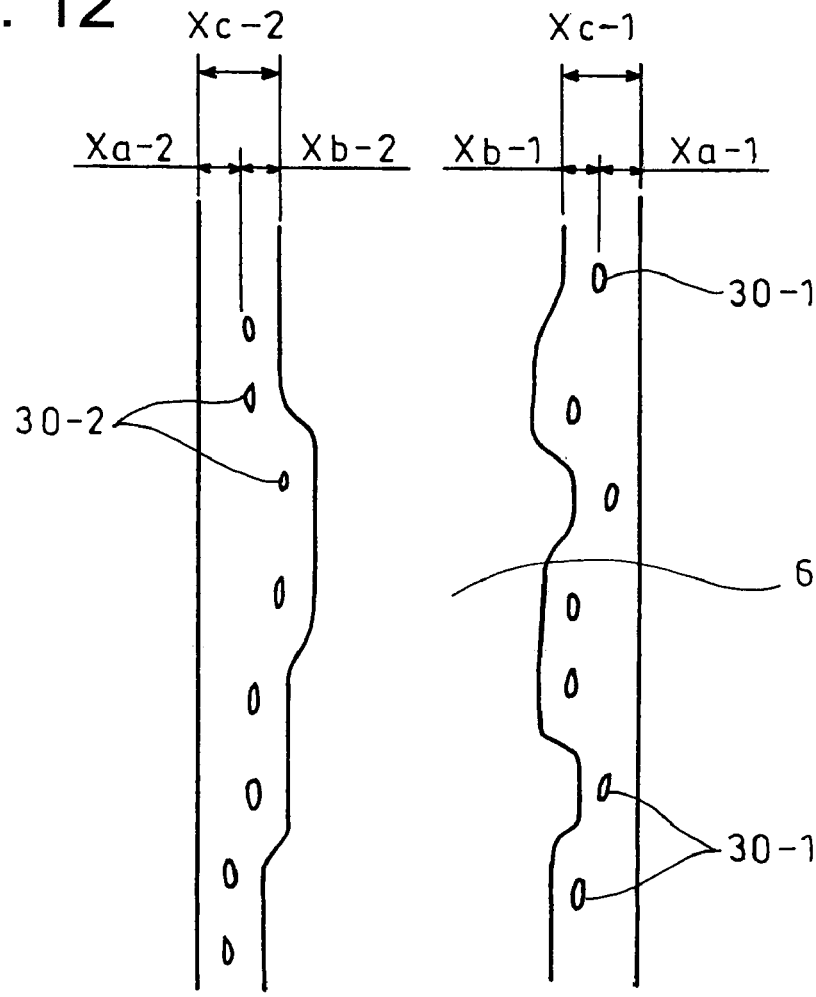
FIG. 12 is a plan view schematically showing determination of a width of the strip to be trimmed in the strip product production installation according to the invention.

When, for example, a flaw 30 is at a distance Xa from the widthwise edge of the strip 6 as shown in FIG. 12, then a width Xc with addition of an extra margin Xb preset in the trimming-amount arithmetic and control unit 22 is a size to be trimmed from the widthwise edge of the strip 6. Thus, the unit 22 transmits the command 25 to the adjuster 29 of the trimmer 16 which adjusts the positions of the blades 27 and 28 widthwise of the strip 6, the drive 26 being driven to trim the widthwise edge of the strip 6 by the width Xc. Generally, the distances to be trimmed and the extra margins are different between the opposite sides so that, in FIG. 12, they are dividedly represented with suffixes −1 and −2.

Also in the case where the signal 24 from the thickness detector 21 reveal any presence of shape defects at the widthwise edges of the strip 6 such as edge-up (increased thickness as compared to a predetermined thickness) or edge-drop (decreased thickness as compared to the predetermined thickness), the trimming-amount arithmetic and control unit 22 transmits the command 25 of the width Xc with addition of the extra margin Xb to the adjuster 29 of the trimmer 16 which adjusts the positions of the blades 27 and 28 widthwise of the strip 6, the drive 26 being driven to trim the widthwise edge of the strip 6 by the required width.

Timing with which the upper and lower blades 27 and 28 are moved widthwise of the strip 6 upon detection of the flaw and/or thickness defect by the flaw detector 20 and/or the thickness detector 21 will be determined as follows. That is, since a moving distance 1 of the strip 6 from the detectors 20 and 21 to a center, in the direction of movement of the strip 6, of the trimmer 16 is preliminarily known and a moving velocity v of the strip 6 is known from the rotational velocity of the pinch rolls 7, then the trimming-amount arithmetic and control unit 22 can calculate time l/v required for portions with the sensed flaw and/or shape defect reaching the trimmer 16. Therefore, after the lapse of the time l/v, the blades 27 and 28 of the trimmer 16 are position-adjusted widthwise of the strip 6 such that the widthwise edge of the strip 6 may be trimmed by the required width including the sensed flaw and/or edge-up or -drop.

The strip 6 with the flaws and/or thickness defects being trimmed away is delivered to the rolling mill 17 into a strip product which passes through the deflector roll and is wound by the coiler 19.

According to the above-mentioned illustrated embodiment, when the strip 6 produced in the continuous casting machine 1 has at its widthwise edges any flaw and/or thickness defect such as edge-up or -drop, the strip is rolled after such defective portions are trimmed away. As a result, prevented are any trouble in rolling due to meanderings and fractures of the strip and flatness defectiveness due to longitudinal plastic flow on the strip after the rolling.

Figure 13:
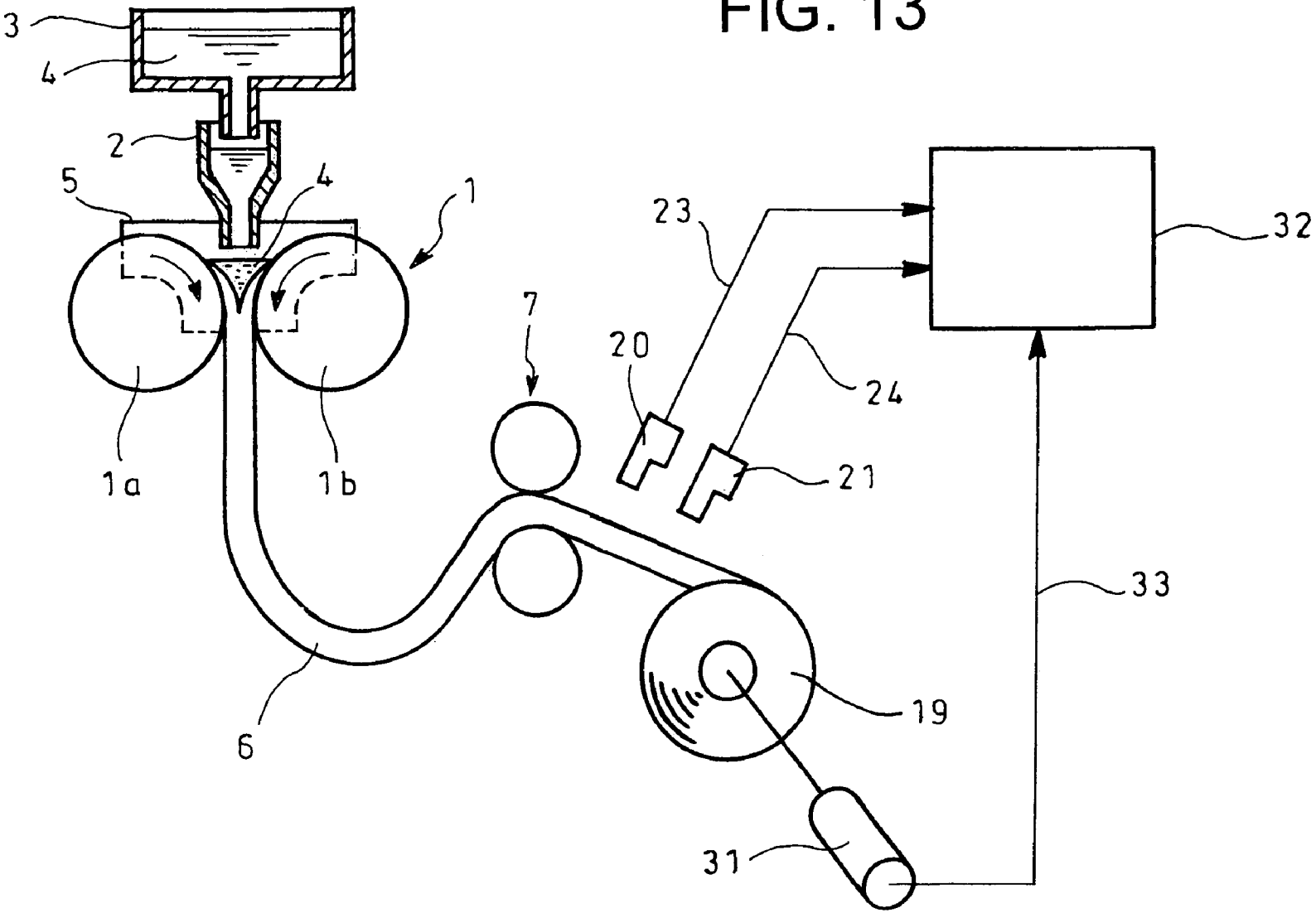
FIG. 13 shows a further embodiment of a strip product production installation according to the invention and is a schematic side view of a continuous casting line.

FIGS. 13-16 show a further embodiment of the invention in which trimmer is arranged not in a continuous casting line with a continuous casting machine and a coiler, but in a cold rolling line downstream of the continuous casting line. FIG. 13 shows a continuous casting line in which parts same as those in FIG. 9 are represented by the same reference numerals. In FIG. 13, reference numeral 31 denotes a position detector connected to a shaft of the coiler 19 to sense a longitudinal position of the strip 6; and 32, a trimming-amount arithmetic and determining unit to determine an amount of the strip to be trimmed and a longitudinal trimming position depending upon the flaw signal 23 from the flaw detector 20, the thickness signal 24 from the thickness detector 21 and the position signal 33 from the position detector 31.

Figure 14:
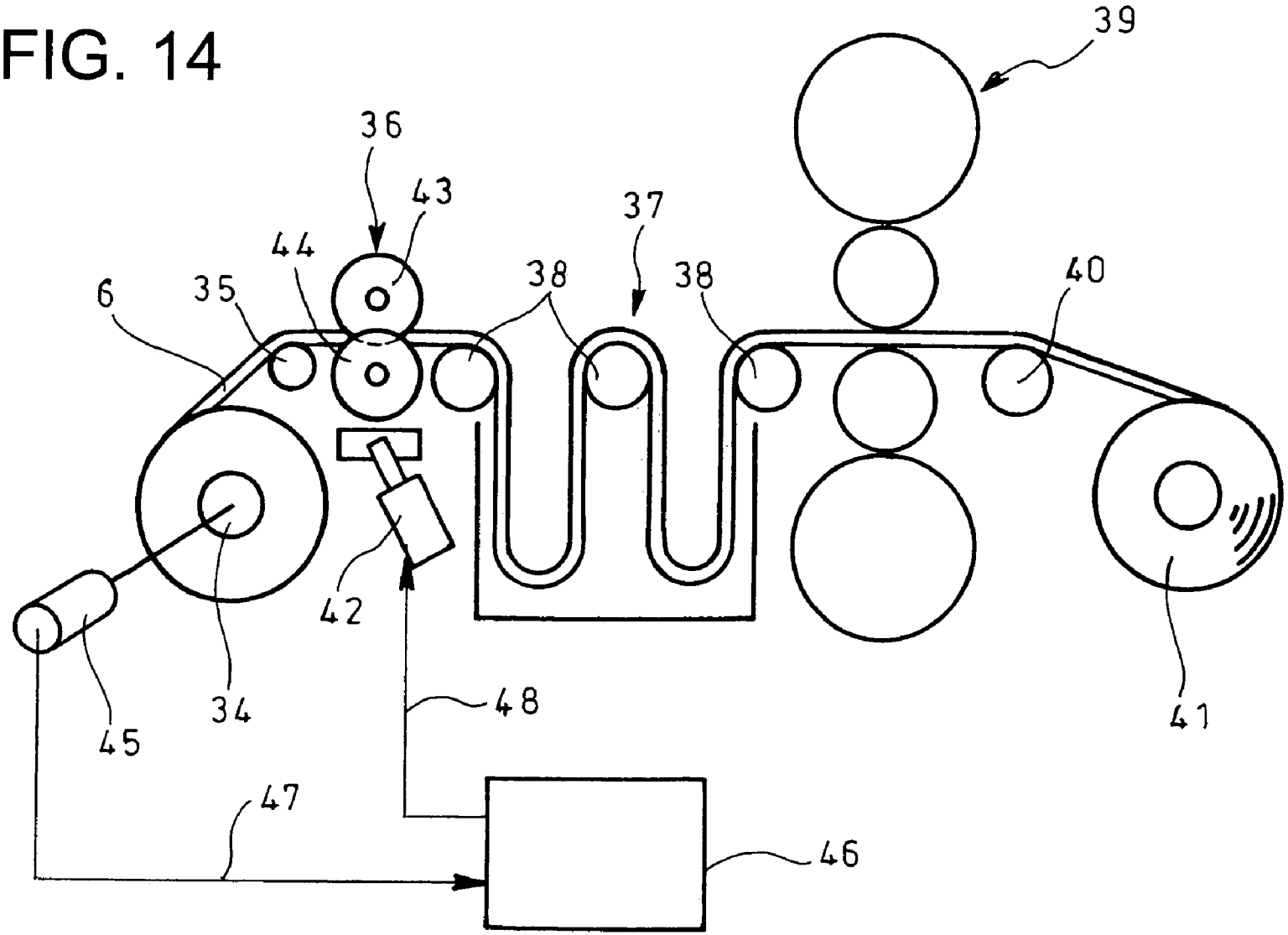
FIG. 14 shows the further embodiment of a strip product production installation and is a schematic side view of a cold rolling line arranged downstream of the continuous casting line.

FIG. 14 shows a cold rolling line arranged downstream of the continuous casting line. In the figure, reference numeral 34 denotes a coiler; 35, a deflector roll arranged downstream of the coiler 34; 36, trimmers with the same structure as those of the trimmers 16; 37, a pickling device arranged downstream of the trimmer 36; 38, guide rollers arranged at entry-, intermediate- and discharge-side of the pickling device 37; 39, a rolling mill arranged downstream of the pickling device 37; 40, a deflector roll arranged downstream of the rolling mill 39; 41, a coiler arranged downstream of the deflector roll 40; 42, a widthwise-position adjuster which adjusts widthwise positions of upper and lower blades 43 and 44 of the trimmer 36; 45, a position detector connected to a shaft of the uncoiler 34 to detect a longitudinal position of the strip 6 uncoiled; and 46, a commander which transmits a setting command 48 to the adjuster 42 depending upon a position signal 47 from the position detector 45.

Next, the mode of operation of the embodiment will be described.

The molten metal 4 fed from the tundish 3 via the molten metal nozzle 2 to the molten metal pool is cooled by the casting rolls 1*a* and 1*b* rotated in the directions of arrows to solidify into a solidified shell which develops into the strip 6. Then, the strip 6 is drawn out between the casting rolls 1*a* and 1*b* by the pinch rolls 7 to be fed downstream and would by the coiler 19 into a coil.

Figure 15:
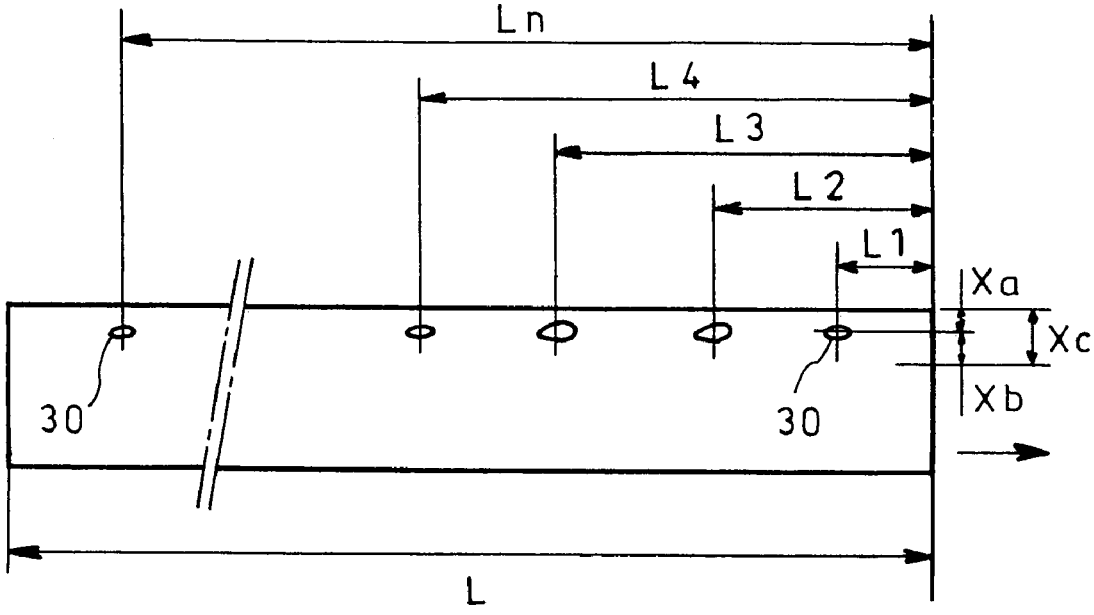
FIG. 15 is a plan view for explanation of longitudinal positions of flaws generated on the strip.

In this respect, the flaws 30 shown in FIG. 15 are sensed by the flaw detector 20 and transmitted in the form of the flaw signals 23 to the trimming-amount arithmetic and determining unit 32 while the longitudinal positions of the strip 6 at which the flaws 30 are sensed by the position detector 31 are transmitted in the form of the position signals 33 to the unit 32. As a result, trimming amount and trimming positions are arithmetically determined.

More specifically, when the flaw 30 is at a distance Xa from the widthwise edge of the strip 6 as shown in FIG. 15, then a width Xc with addition of an extra margin Xb preset in the trimming-amount arithmetic and determining unit 32 is a size to be trimmed from the widthwise edge of the strip 6. Moreover, longitudinal positions L1, L2, L3, L4 . . . Ln of the flaws 30 on the strip 6 with respect to a tip end of the strip 6 are transmitted to the trimming-amount arithmetic and determining unit 32. Reference letter L denotes an entire length of the strip 6.

The strip 6 wound by the coiler 19 into the coil in the continuous casting line is placed on the uncoiler 34 of the cold rolling line, the uncoiler 34 being driven to uncoil the strip 6. In this case, data for the setting command obtained by the trimming-amount arithmetic and determining unit 32 are preliminarily afforded to the commander 46.

The strip 6 uncoiled by the uncoiler 34 is delivered via the deflector roll 35 to the trimmers 36 where portions with the flaws 30 or thickness defects on the widthwise edges of the strip 6 are trimmed by the upper and lower blades 43 and 44 by the width Xc. The trimmed strip is pickled by the pickling device 37 and delivered to the rolling mill 39 where the strip is cold-rolled and then the strip is delivered via the deflector roll 40 to the coiler 41 for coiling.

Figure 16:
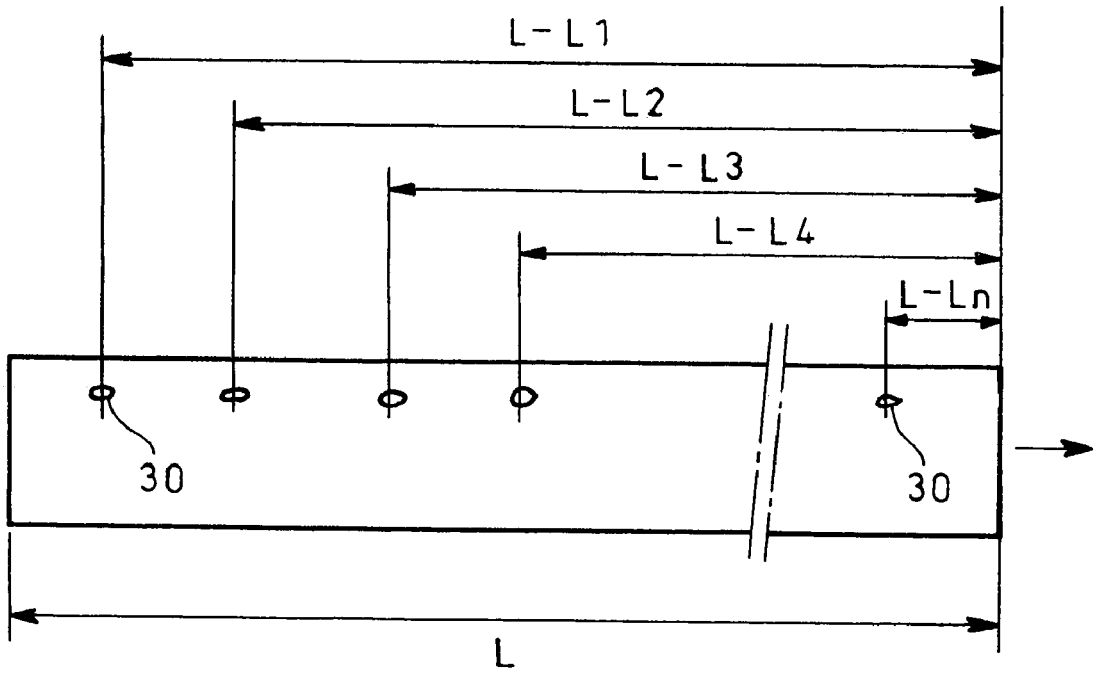
FIG. 16 is a plan view for explanation of longitudinal positions of the strip for position adjustment of the upper and lower blades of the trimmers when flaws on the strip are to be trimmed.

Upon trimming by the trimmers 36, the widthwise-position adjuster 42 is driven with the sensed position signal 47 and the preliminarily afforded data from the commander 46 to adjust the positions of the blades 43 and 44 widthwise of the strip 6. More specifically, since the trailing end of the strip 6 in the continuous casting line provides a leading end of the strip upon uncoiling by the uncoiler 34, then in the case of the flaws 30 at the longitudinal positions shown in FIG. 15, upon trimming, the positions of the blades 43 and 44 are adjusted as shown in FIG. 16 such that the width to be trimmed is Xc at the positions L-Ln . . . L-L4, L-L3, L-L2, L-L1 from the leading end of the strip 6 upon uncoiling.

Also in this embodiment, when the strip 6 produced in the continuous casting machine 1 has at its widthwise edges any flaw and/or thickness defect, the strip is rolled after such defective portions are trimmed away. As a result, prevented are any trouble in rolling due to meanderings and fractures of the strip and flatness defectiveness due to longitudinal plastic flow on the strip after the rolling.

It is to be understood that a strip product production installation according to the invention is not limited to the above-mentioned embodiments and that various changes and modifications may be made without deferring from the scope of the invention.

INDUSTRIAL APPLICABILITY

As is disclosed above, a strip product production installation according to the invention exhibits great effects with respect to a general cast strip thickness or especially a cast strip thickness of less than 15 mm since the strip, which is produced in the continuous casting machine and has at its widthwise edges any flaw and/or thickness defect, can be rolled after such defective portions are trimmed. As a result, prevented are any trouble in rolling due to meanderings and fractures of the strip and flatness defectiveness due to longitudinal plastic flow on the strip after the rolling.

The invention claimed is:

1. A strip product production installation, which comprises:

a plurality of trimmers for trimming widthwise edges of a strip, said trimmers being arranged upstream of a rolling mill arranged downstream of a twin- or single-roll continuous casting machine supplied with molten metal from a tundish arranged above for continuously casting a strip with a predetermined width and which further comprises a plurality of flaw and thickness detectors arranged upstream of the trimmers for sensing flaws on the widthwise edges of the strip and for sensing thickness widthwise of the strip, respectively, and means for adjusting positions of said trimmer blades widthwise of the strip on the basis of an output from said flaw detector and/or an output from said thickness detector.

* * * * *